US011686029B2

(12) United States Patent
Roetker et al.

(10) Patent No.: US 11,686,029 B2
(45) Date of Patent: Jun. 27, 2023

(54) WASHING MACHINE APPLIANCE AND AN AGITATOR THEREFOR

(71) Applicant: Haier US Appliance Solutions, Inc., Wilmington, DE (US)

(72) Inventors: John Joseph Roetker, Louisville, KY (US); Ryan Persaud, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 78 days.

(21) Appl. No.: 17/224,574

(22) Filed: Apr. 7, 2021

(65) Prior Publication Data

US 2022/0325458 A1 Oct. 13, 2022

(51) Int. Cl.
*D06F 13/02* (2006.01)
*D06F 23/04* (2006.01)
*D06F 25/00* (2006.01)

(52) U.S. Cl.
CPC ..... *D06F 13/02* (2013.01); *D06F 23/04* (2013.01); *D06F 25/00* (2013.01)

(58) Field of Classification Search
CPC ..... D06F 13/02; D06F 23/04; D06F 25/00
See application file for complete search history.

(56) References Cited

U.S. PATENT DOCUMENTS 4,803,855 A 2/1989 Kennedy
4,920,770 A * 5/1990 Dooley ..... D06F 13/02 68/133
5,784,902 A * 7/1998 Pinkowski ..... D06F 13/02 68/12.02
7,069,752 B2 * 7/2006 Clark ..... D06F 13/02 68/133
9,115,452 B2 8/2015 Carr
9,803,304 B2 10/2017 Calmeise
10,787,761 B2 9/2020 Czarnecki
(Continued)

FOREIGN PATENT DOCUMENTS

CN 203530690 U 4/2014
CN 203729101 U 7/2014
(Continued)

OTHER PUBLICATIONS

Machine translation of EP-0214039-A1 to Herve et al. (Year: 1987).*

*Primary Examiner* — Joseph L. Perrin
(74) *Attorney, Agent, or Firm* — Dority & Manning, P.A.

(57) ABSTRACT

A washing machine appliance or agitator may include an impeller base and an extended post. The impeller base may define a rotation axis and include one or more impeller fins and a mating collar. The mating collar may be disposed radially inward from the impeller fins and extend along the rotation axis. The extended post may be removably attached to the impeller base to rotate therewith. The extended post may include a base body, an auger fin, an overmolded bottom bracket, and a connector bolt. The base body may extend between a bottom end proximal to the impeller base and a top end distal to the impeller base. The auger fin may extend radially from the base body. The overmolded bottom bracket may be disposed on the base body. The connector bolt may attach the extended post to the impeller base.

20 Claims, 10 Drawing Sheets

(56) References Cited

U.S. PATENT DOCUMENTS

| | | | | |
|---|---|---|---|---|
| 2004/0016267 | A1* | 1/2004 | Clark | D06F 13/02 68/133 |
| 2019/0017208 | A1* | 1/2019 | Marangoni | D06F 37/16 |
| 2019/0062978 | A1* | 2/2019 | Czarnecki | D06F 34/28 |
| 2021/0062382 | A1* | 3/2021 | Andrejczuk | D06F 17/10 |
| 2022/0235512 | A1* | 7/2022 | Bixby | D06F 39/10 |

FOREIGN PATENT DOCUMENTS

| | | | |
|---|---|---|---|
| CN | 204898347 | U | 12/2015 |
| EP | 0214039 | A1 * | 3/1987 |

* cited by examiner

WASHING MACHINE APPLIANCE AND AN AGITATOR THEREFOR

FIELD OF THE INVENTION

The present subject matter relates generally to washing machine appliances and an agitation element for the same.

BACKGROUND OF THE INVENTION

A vertical axis washing machine appliance generally includes a tub with a basket rotatably positioned within the tub. Articles to be washed, such as clothes, are placed in the machine's basket. An agitation element can be included in the tub, and can rotate to move articles within the basket to facilitate washing. Agitation elements are typically impellers, single-action agitation elements, or dual-action agitation elements. Generally, such an agitation element reciprocates about a rotation axis (e.g., vertical axis) within the machine's basket. In some instances, fins extend from a rigid shaft of the agitation element to contact and move the articles. The surface of the basket and gravity may be used in conjunction with such agitation elements to impart a circular motion of the articles, known as "turnover," from a top of the basket, to a bottom of the basket, and back up to the top of the basket.

Different agitation elements typically come with different advantages and disadvantages. In the case of single-action and dual-action agitation elements, users may perceive greater agitation and turnover of articles during a washing operation or cycle than with an impeller agitation element. In the case of impeller agitation elements, a greater volume or portion of the wash basket may be available or better able to handle bulky items (e.g., towels, bedding, etc.) than a single-action or dual-action agitation element.

Generally, a manufacturer has to decide what type of agitation element is desired at the point of manufacturing assembly. In turn, each discrete model of a washing machine appliance may require a unique agitation element that does not share parts with another model. The limitations in configuration flexibility may lead to increased expenses and manufacturing process complexity with a washing machine appliance unit. As a result, it would be useful if a manufacturer could have greater flexibility, particularly with regard to the type of agitation element that is used for any given washing machine configuration. Therefore, it would be advantageous to provide a washing machine appliance or assembly wherein an agitation element (or portions thereof) could be readily removed or assembled with multiple configurations during assembly.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a washing machine appliance is provided. The washing machine appliance may include a tub, a basket, an impeller base, and an extended post. The basket may be rotatably positioned within the tub. The impeller base may be rotatably mounted within the basket and define a rotation axis. The impeller base may include one or more impeller fins extending radially outward from the rotation axis, and a mating collar disposed radially inward from the impeller fins and extending along the rotation axis. The extended post may be removably attached to the impeller base to rotate therewith. The extended post may include a base body, an auger fin, and a connector bolt. The base body may extend along the rotation axis between a bottom end proximal to the impeller base and a top end distal to the impeller base. The auger fin may extend radially from the base body between the bottom end and the top end. The overmolded bottom bracket may be disposed on the base body at the bottom end. The connector bolt may extend through the overmolded bottom bracket to the mating collar to attach the extended post to the impeller base.

In another exemplary aspect of the present disclosure, an agitation element for a washing machine appliance is provided. The agitation element may include an impeller base and an extended post. The impeller base may define a rotation axis and include one or more impeller fins and a mating collar. The one or more impeller fins may extend radially outward from the rotation axis. The mating collar may be disposed radially inward from the impeller fins and extend along the rotation axis. The extended post may be removably attached to the impeller base to rotate therewith. The extended post may include a base body, an auger fin, an overmolded bottom bracket, and a connector bolt. The base body may extend along the rotation axis between a bottom end proximal to the impeller base and a top end distal to the impeller base. The auger fin may extend radially from the base body between the bottom end and the top end. The overmolded bottom bracket may be disposed on the base body at the bottom end. The connector bolt may extend through the overmolded bottom bracket to the mating collar to attach the extended post to the impeller base.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
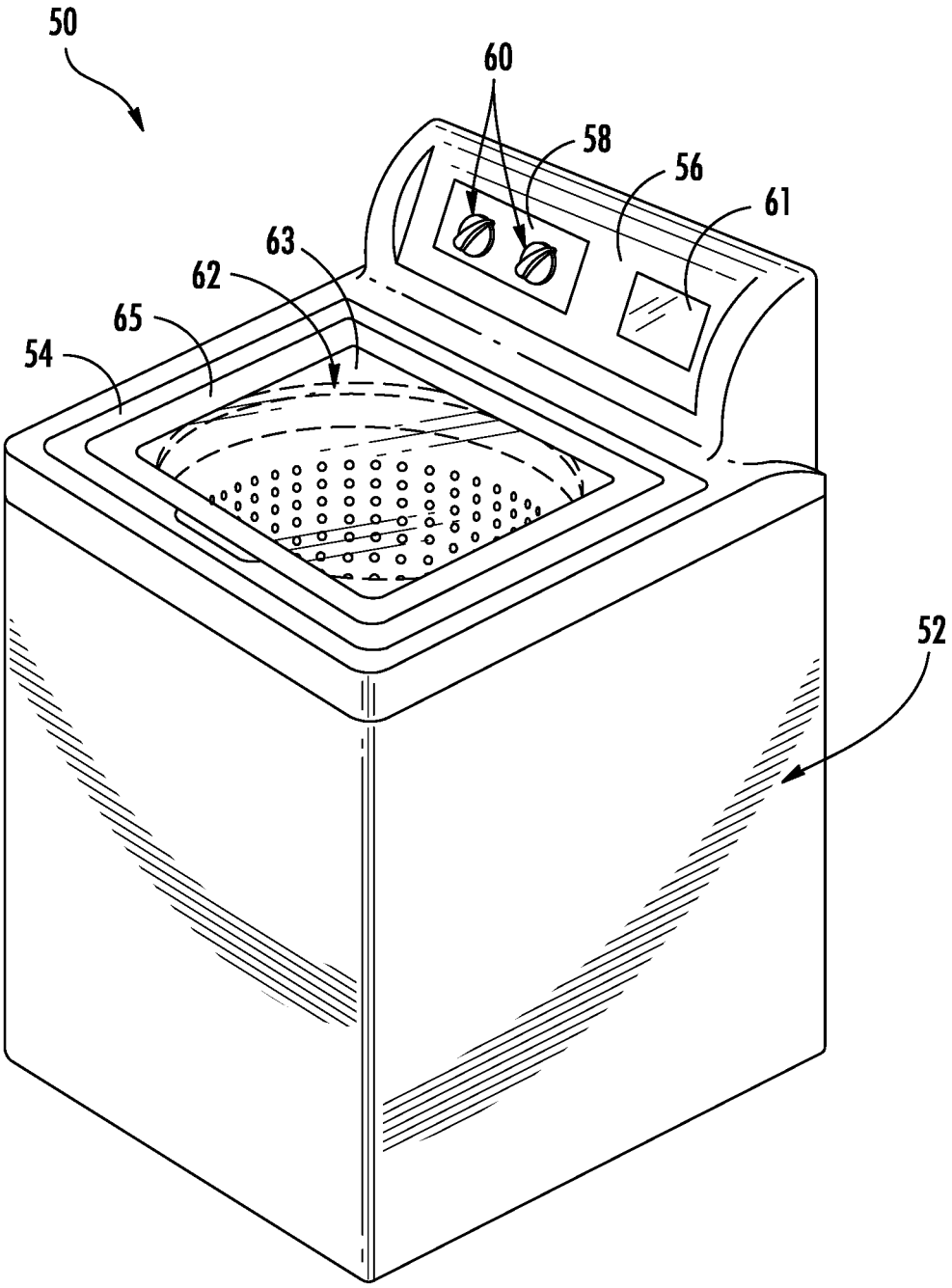
FIG. 1 provides a perspective view of a washing machine appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The phrase "in one embodiment," does not necessarily refer to the same embodiment, although it may. The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Figure 2:
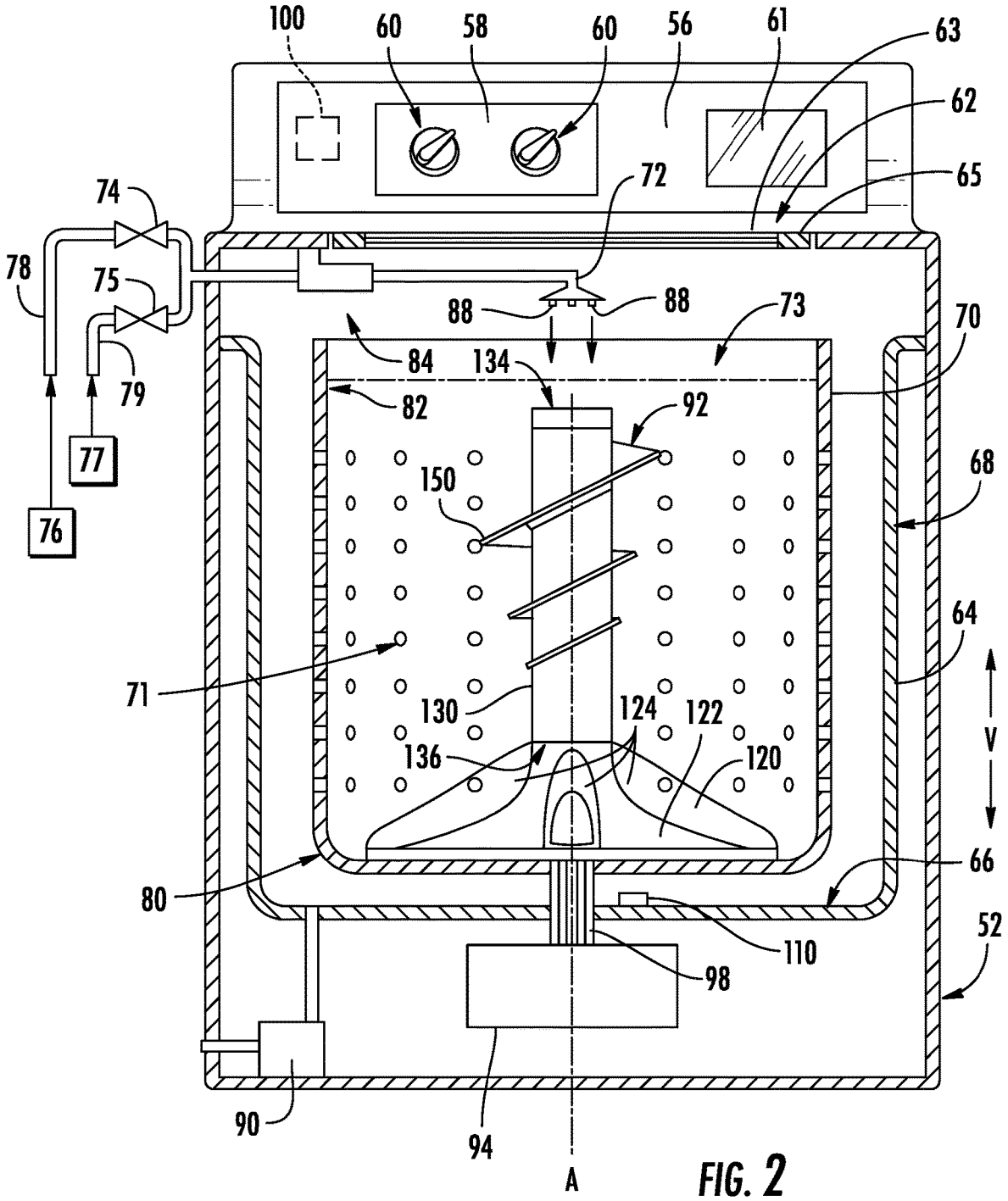
FIG. 2 provides a sectional elevation view of the exemplary washing machine appliance of FIG. 1.
Figure 3:
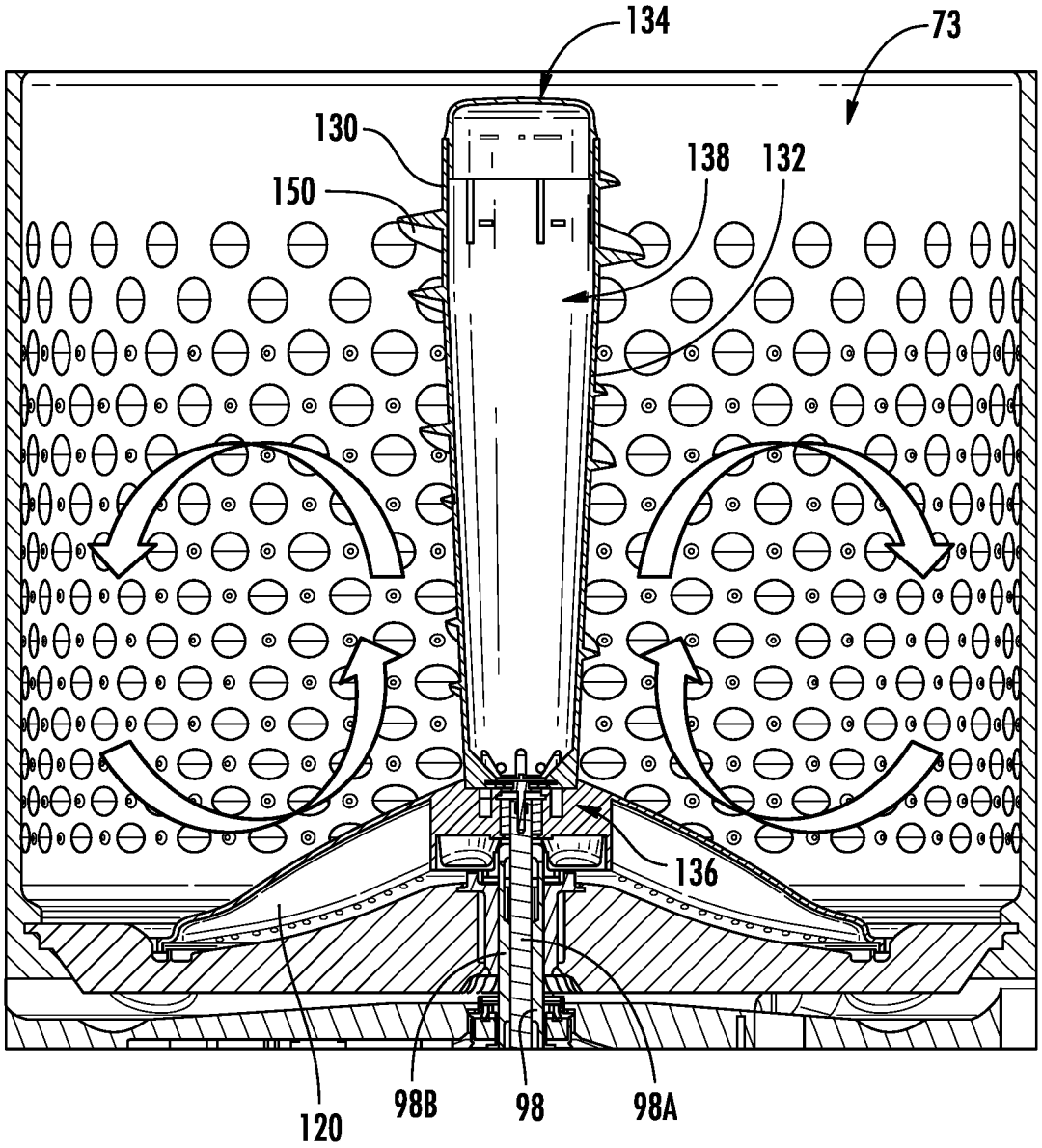
FIG. 3 provides a sectional elevation view of the wash basket and agitation element of the exemplary washing machine appliance of FIG. 1.
Figure 4:
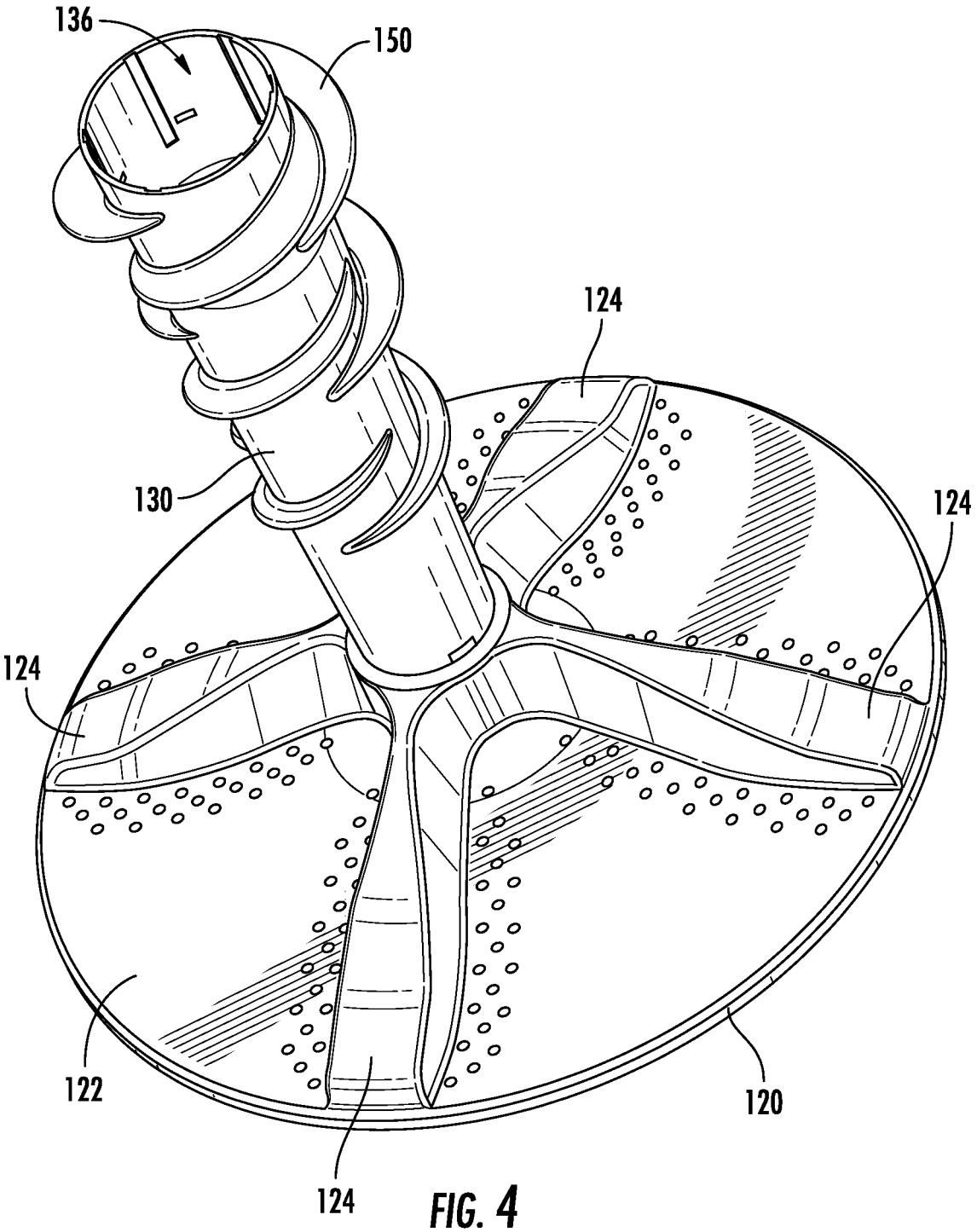
FIG. 4 provides a perspective view of an agitation element, in isolation, according to exemplary embodiments of the present disclosure.
Figure 5:
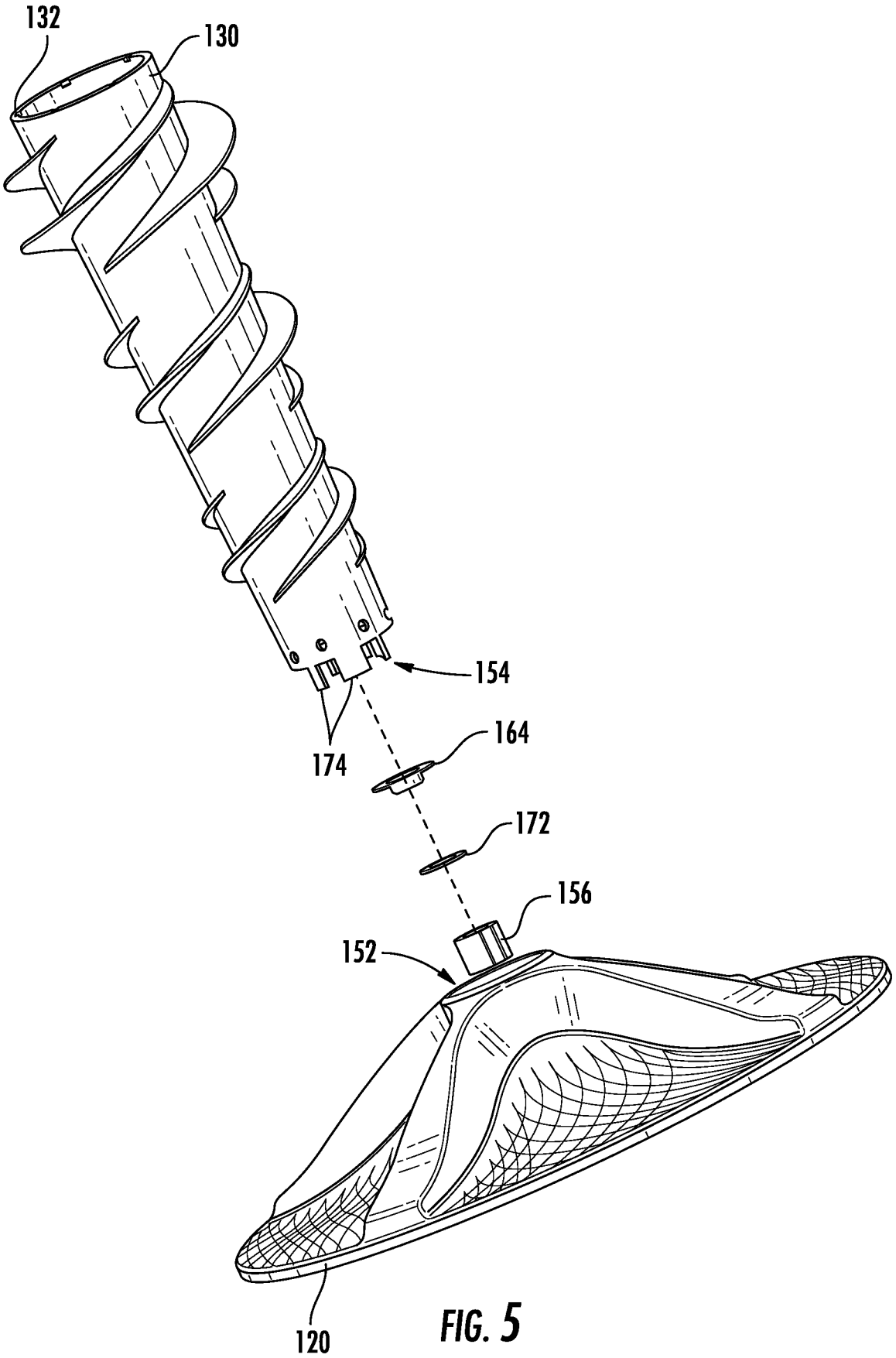
FIG. 5 provides an exploded perspective of the exemplary agitation element of FIG. 4.
Figure 6:
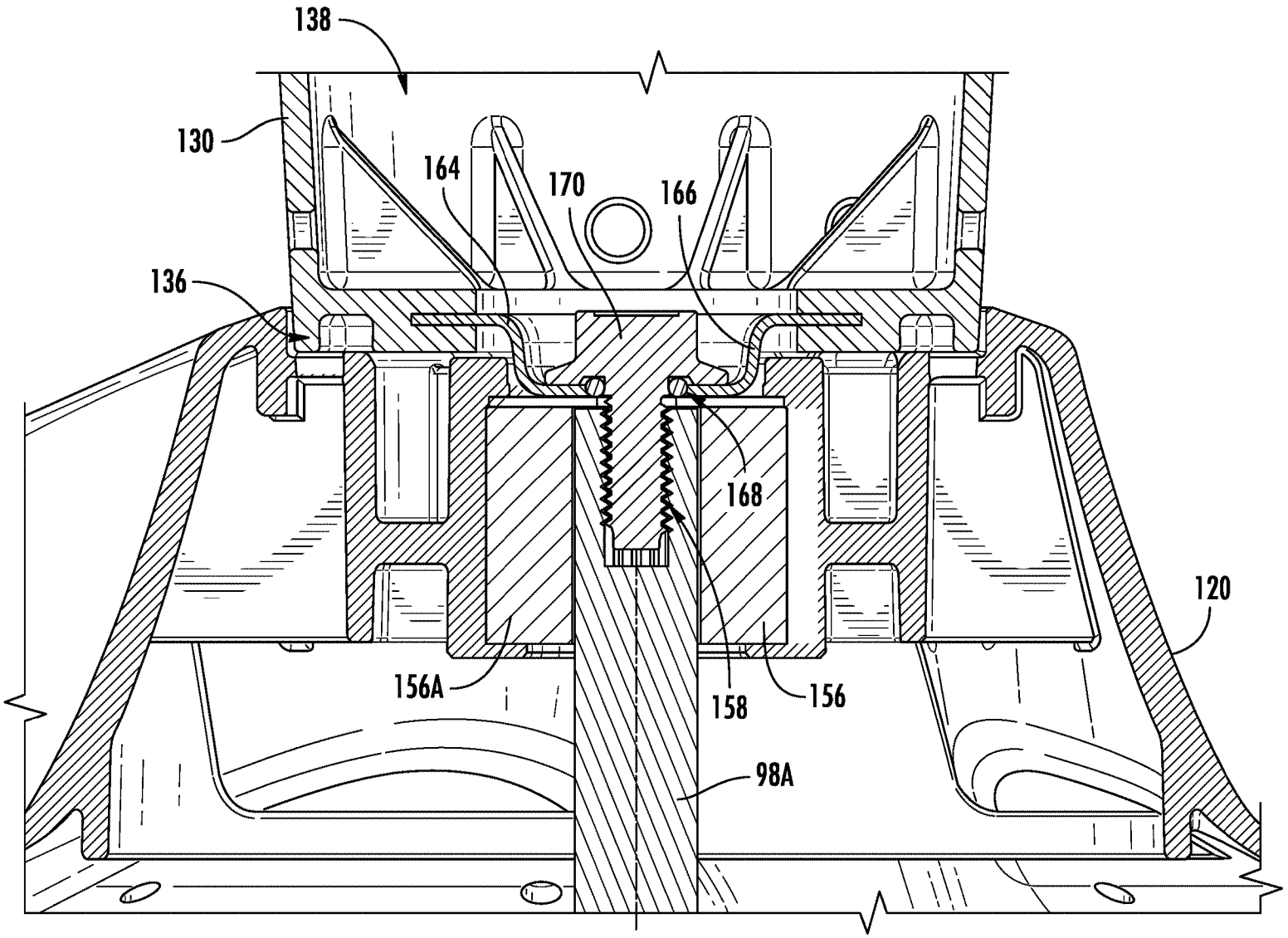
FIG. 6 provides a magnified sectional view of a connection between an agitator shaft and impeller base according to exemplary embodiments of the present disclosure.
Figure 7:
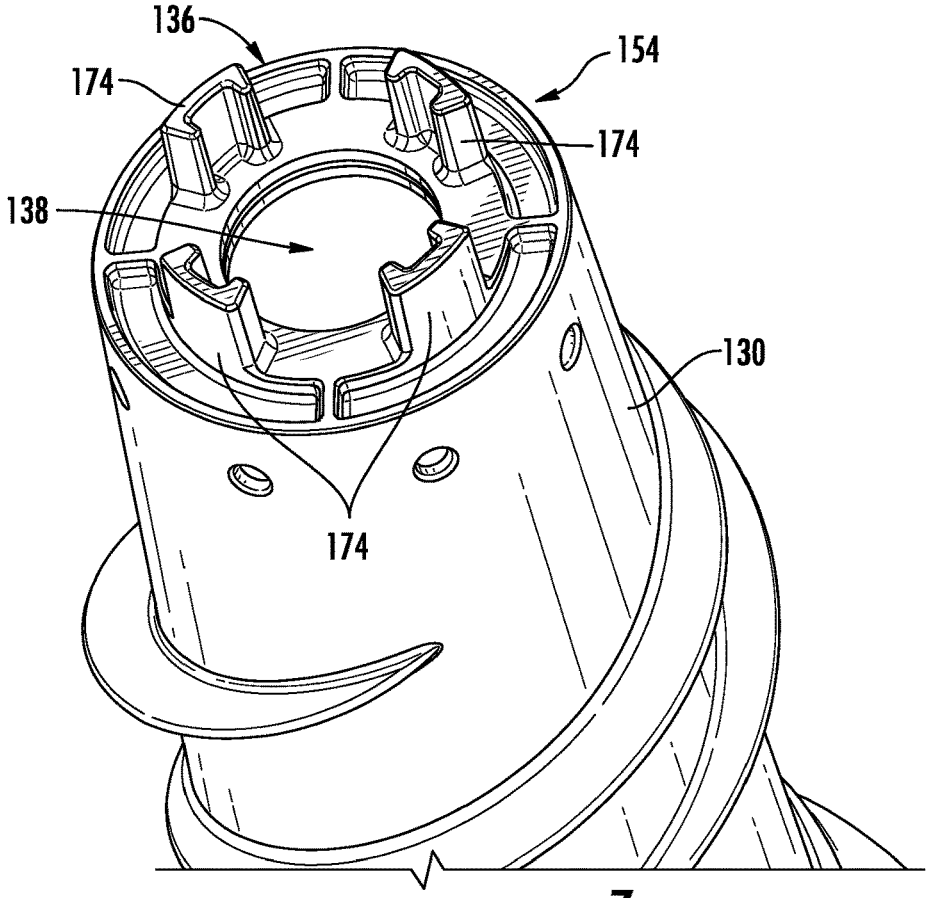
FIG. 7 provides a bottom perspective view of a portion of an exemplary agitator shaft.
Figure 8:
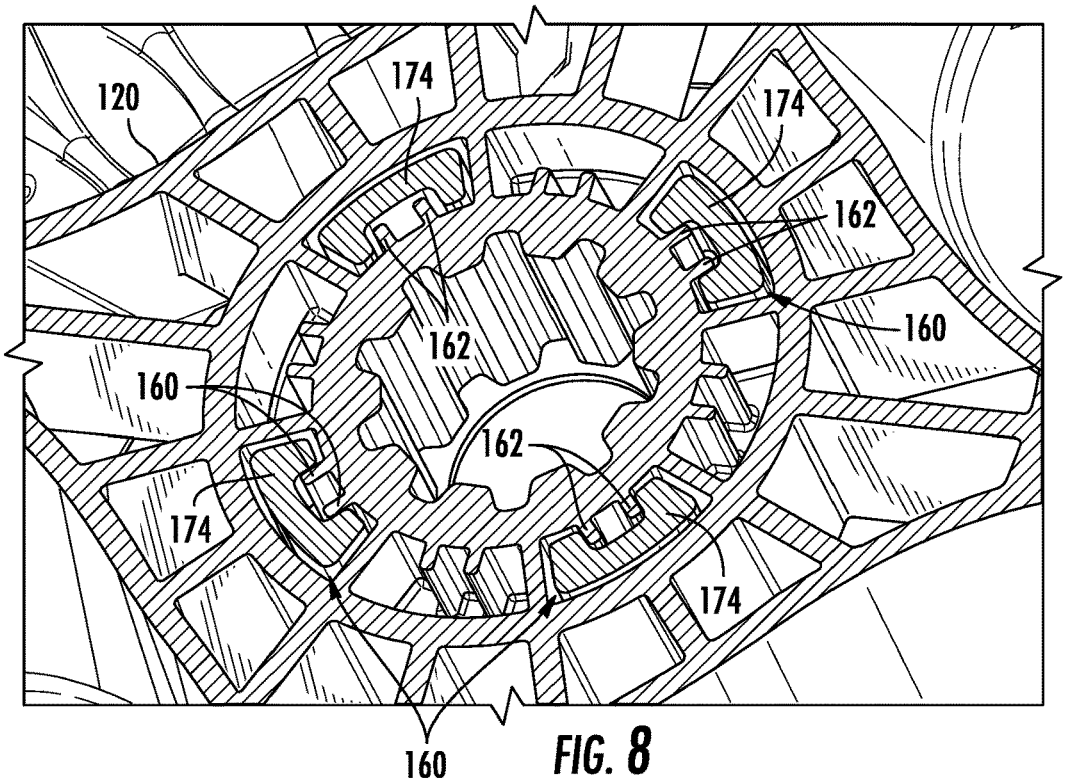
FIG. 8 provides a sectional perspective view of a portion of an exemplary impeller base.

Turning now to the figures, FIGS. 1 and 2 provide separate views of a washing machine appliance 50 according to exemplary embodiments of the present disclosure. As shown, washing machine appliance 50 generally defines a vertical direction V, a lateral direction L, and a transverse direction T. The vertical direction V, lateral direction L, and transverse direction T are each mutually perpendicular and form an orthogonal direction system.

Washing machine appliance 50 may include a cabinet 52 and a cover 54. A backsplash 56 extends from cover 54, and a control panel 58, including a plurality of input selectors 60, is coupled to backsplash 56.

Control panel 58 and input selectors 60 collectively form a user interface input for operator selection of machine cycles and features, and in one embodiment, a display 61 indicates selected features, a countdown timer, or other items of interest to machine users. It should be appreciated, however, that in other exemplary embodiments, the control panel 58, input selectors 60, and display 61, may have any other suitable configuration. For example, in other exemplary embodiments, one or more of the input selectors 60 may be configured as manual "push-button" input selectors, or alternatively may be configured as a touchscreen (e.g., on display 61).

A lid 62 may be mounted to cover 54 and rotatable between an open position (not shown) facilitating access to a tub, also referred to as a wash tub, 64 located within cabinet 52 and a closed position (FIG. 1) forming an enclosure over tub 64. Lid 62 in exemplary embodiment includes a transparent panel 63, which may be formed of, for example, glass, plastic, or any other suitable material. The transparency of the panel 63 allows users to see through the panel 63, and into the tub 64 when the lid 62 is in the closed position. In some embodiments, the panel 63 itself can generally form the lid 62. In other embodiments, the lid 62 includes the panel 63 and a frame 65 surrounding and encasing the panel 63. Alternatively, panel 63 need not be transparent.

As may be seen in FIG. 2, tub 64 includes a bottom wall 66 and a sidewall 68. A wash drum or basket 70 is rotatably mounted within tub 64. In particular, basket 70 is rotatable about a central axis, which may when properly balanced and positioned in the embodiment illustrated be a vertical axis. Thus, washing machine appliance is generally referred to as a vertical axis washing machine appliance. Basket 70 defines a wash chamber 73 for receipt of articles for washing and extends, for example, vertically, between a bottom portion 80 and a top portion 82. Basket 70 includes a plurality of openings or perforations 71 therein to facilitate fluid communication between an interior of basket 70 and tub 64.

A nozzle 72 is configured for flowing a liquid into tub 64. In particular, nozzle 72 may be positioned at or adjacent to top portion 82 of basket 70. Nozzle 72 may be in fluid communication with one or more water sources 76, 77 in order to direct liquid (e.g. water) into tub 64 or onto articles within chamber 73 of basket 70. Nozzle 72 may further include apertures 88 through which water may be sprayed into the tub 64. Apertures 88 may, for example, be tubes extending from the nozzles 72 as illustrated, or simply holes defined in the nozzles 72 or any other suitable openings through which water may be sprayed. Nozzle 72 may additionally include other openings, holes, etc. (not shown) through which water may be flowed (i.e. sprayed or poured) into the tub 64.

Various valves may regulate the flow of fluid through nozzle 72. For example, a flow regulator may be provided to control a flow of hot or cold water into the wash chamber of washing machine appliance 50. For the embodiment depicted, the flow regulator includes a hot water valve 74 and a cold water valve 75. The hot and cold water valves 74, 75 are used to flow hot water and cold water, respectively, therethrough. Each valve 74, 75 can selectively adjust to a closed position in order to terminate or obstruct the flow of fluid therethrough to nozzle 72. The hot water valve 74 may be in fluid communication with a hot water source 76, which may be external to the washing machine appliance 50. The cold water valve 75 may be in fluid communication with a cold water source 77, which may be external to the washing machine appliance 50. The cold water source 77 may, for example, be a commercial water supply, while the hot water source 76 may be, for example, a water heater. Such water sources 76, 77 may supply water to the appliance 50 through the respective valves 74, 75. A hot water conduit 78 and a cold water conduit 79 may supply hot and cold water, respectively, from the sources 76, 77 through the respective valves 74, 75 and to the nozzle 72.

An additive dispenser 84 may additionally be provided for directing a wash additive, such as detergent, bleach, liquid fabric softener, etc., into the tub 64. For example, dispenser 84 may be in fluid communication with nozzle 72 such that water flowing through nozzle 72 flows through dispenser 84, mixing with wash additive at a desired time during operation to form a liquid or wash fluid, before being flowed into tub 64. For the embodiment depicted, nozzle 72 is a separate downstream component from dispenser 84. In other exemplary embodiments, however, nozzle 72 and dispenser 84 may be integral, with a portion of dispenser 84 serving as the nozzle 72, or alternatively dispenser 84 may be in fluid communication with only one of hot water valve 74 or cold water valve 75. In still other exemplary embodiments, the washing machine appliance 50 may not include a dispenser, in which case a user may add one or more wash additives directly to wash chamber 73. A pump assembly 90 (shown schematically in FIG. 2) is located beneath tub 64 and basket 70 for gravity assisted flow to drain tub 64.

As will be described in greater detail herein, an agitation element 92 is oriented to rotate about a rotation axis A (e.g., parallel to the central axis or vertical direction V). Generally, agitation element 92 includes an impeller base 120 and extended post 130. The agitation element 92 depicted is positioned within the basket 70 to impart motion to the articles and liquid in the chamber 73 of the basket 70. More particularly, the agitation element 92 depicted is provided to impart downward motion of the articles along the vertical direction V. For example, with such a configuration, during operation of the agitation element 92 the articles may be moved upwardly along the vertical direction V at a center of the basket 70, outwardly from the center of basket 70 at the bottom portion 80 of the basket 70, then upwardly along the vertical direction V towards the top portion 82 of the basket 70. This movement of the articles is generally described as inverse toroidal motion.

In optional embodiments, basket 70 and agitation element 92 are both driven by a motor 94. Motor 94 may, for example, be a pancake motor, direct drive brushless motor, induction motor, or other motor suitable for driving basket 70 and agitation element 92. The motor 94 may be connected to the agitation element 92, either directly or through a torque multiplying transmission gear set, through output shaft 98 (e.g., an internal shaft 98A thereof). The basket 70 is connected to the motor 94 through output shaft 98 (e.g., an outer shaft 98B thereof). As motor output shaft 98 is rotated, basket 70 and agitation element 92 are operated for rotatable movement within tub 64 (e.g., about rotation axis A). The agitation element 92 may be reversibly rotated about rotation axis A by the motor 94. The operational modes of reversible rotation of the agitation element or single direction rotation of the basket is determined by engagement or disengagement of a clutch mechanism coupling the motor to the respective internal and outer shafts 98A, 98B of output shaft 98. Washing machine appliance 50 may also include a brake assembly (not shown) selectively applied or released for respectively maintaining basket 70 in a stationary position within tub 64 or for allowing basket 70 to spin within tub 64.

Various sensors may additionally be included in the washing machine appliance 50. For example, a pressure sensor 110 may be positioned in the tub 64 as illustrated or, alternatively, may be remotely mounted in another location within the appliance 50 and be operationally connected to tub 64 by a hose (not shown). Any suitable pressure sensor 110, such as an electronic sensor, a manometer, or another suitable gauge or sensor, may be used. The pressure sensor 110 may generally measure the pressure of water in the tub 64. This pressure can then be used to estimate the height or amount of water in the tub 64. Additionally, a suitable speed sensor can be connected to the motor 94, such as to the output shaft 98 thereof, to measure speed and indicate operation of the motor 94. Other suitable sensors, such as temperature sensors, water sensors, moisture sensors, etc., may additionally be provided in the washing machine appliance 50.

Operation of washing machine appliance 50 is controlled by a processing device or controller 100, that is operatively coupled to the input selectors 60 located on washing machine backsplash 56 for user manipulation to select washing machine cycles and features. Controller 100 may further be operatively coupled to various other components of appliance 50, such as the flow regulator (including valves 74, 75), motor 94, pressure sensor 110, other suitable sensors, etc. In response to user manipulation of the input selectors 60, controller 100 may operate the various components of washing machine appliance 50 to execute selected machine cycles and features.

While described in the context of specific embodiments of washing machine appliance 50, using the teachings disclosed herein it will be understood that washing machine appliance 50 is provided by way of example only. Other washing machine appliances having different configurations, different appearances, or different features may also be used with the present subject matter as well.

Turning now generally to FIGS. 2 through 12, agitation element 92 may include or be provided as a removable agitation element having an extended post 130 selectively attached to impeller base 120. Generally, impeller base 120 includes an impeller platform 122 having one or more impeller fins 124 extending therefrom, as would generally be understood. In the illustrated embodiments, impeller base 120 includes four discrete impeller fins 124 that extends upward from impeller platform 122 and radially outward from rotation axis A. Nonetheless, it is understood that any suitable number of impeller fins 124 may be provided. When assembled, impeller base 120 is generally connected to or in mechanical communication with motor 94, such as through the output shaft 98. Thus, impeller base 120 may be rotated, oscillated, or otherwise motivated by motor 94 (e.g., during a washing operation or wash cycle, as directed by controller 100).

When assembled, extended post 130 may generally extend along the rotation axis A above the impeller base 120. Specifically, extended post 130 may include a base body 132 extending along the rotation axis A between a bottom end 136 and a top end 134. As shown, base body 132 may be mounted within wash chamber 73 such that bottom end 136 is attached or otherwise proximal to the impeller base 120 while top end 134 is held distal to impeller base 120. Between top end 134 and bottom end 136, one or more auger fins 150 may extend radially from extended post 130 (e.g., to engage and agitate articles within wash chamber 73). In the illustrated embodiments, auger fin 150 is formed as a helical coil (or coils) wrapped about extended post 130. Nonetheless, any suitable shape or number of auger fins may be provided in alternative embodiments, as would be understood.

Turning especially to FIGS. 6 through 12, impeller base 120 may provide a mounting face 152 that selectively connects to a mating face 154 of extended post 130. As shown, mounting face 152 is disposed inward from the impeller fins 124. Thus, mounting face 152 may be located closer to rotation axis A than impeller fins 124. Moreover, mounting face 152 is generally coaxial with rotation axis A (e.g., at a radial center of impeller base 120). In some embodiments, mounting face 152 includes or forms a mating collar 156 (e.g., disposed at a top end of impeller base 120). For instance, mating collar 156 may include a metal spline 156A inserted or overmolded within a polymer material or portion of impeller base 120.

In certain embodiments, a threaded axial hole 158 is defined radially inward from the mating collar 156 or outer shaft 98B and extends along the rotation axis A. For instance, threaded axial hole 158 may be defined by and at an upper end of output shaft 98 (e.g., the upper end of the internal shaft 98A of output shaft 98). The mounting thread may extend about the rotation axis A or an axial hole 158 defined by mating collar 156 (e.g., parallel to the rotation axis A). Thus, the mounting thread may follow a helical path that surrounds rotation axis A and provides multiple turns along an axial distance. Optionally, internal shaft 98A may extend through a central hole of mating collar 156. In some embodiments, an outer radial surface of internal shaft 98A is splined to complement an inner radial surface of mating collar 156. Specifically, the metal spline 156A of mating collar 156 may have an inner splined surface to enmesh with the outer radial surface of internal shaft 98A. As shown, the metal spline 156A may further include an outer splined surface to engage or complement an inner surface of the polymer portion of impeller base 120.

Separate from or in addition to the mating collar 156, mounting face 152 may define one or more receiver slots 160. For instance, multiple receiver slots 160 may be defined and circumferentially spaced apart from each other about the rotation axis A (e.g., radially outward therefrom). Each receiver slot 160 may be disposed at the same, or at a discrete, radial distance from the mating collar 156. As shown, such receiver slots 160 may face upward. In turn, the receiver slots 160 may be open along the vertical direction V (FIG. 2). All or some of the receiver slots 160 may be horizontally bounded. In other words, the receiver slots 160 may be horizontally closed. Optionally, a bottom surface may define the lower limits of the receiver slots 160. Thus, one or more of the receiver slots 160 may provide a self-contained pocket. In certain embodiments, one or more interior ridges 162 extend within one or more of the receiver slots 160. Specifically, the interior ridges 162 may extend radially outward from the mating collar 156. In the illustrated embodiments, each receiver slot 160 includes one or more interior ridges 162 therein.

Extended post 130 may provide a complementary structure to engage or interlock with the mounting face 152 of impeller base 120. In some embodiments, extended post 130 includes a mating face 154 disposed on bottom end 136 to rest against or interlock with the mounting face 152. For instance, mating face 154 may include an overmolded bottom bracket 164 disposed on the base body 132 at the bottom end 136. In some such embodiments, overmolded bottom bracket 164 includes or is formed as a metal bracket frame 166 that is overmolded within a non-metallic polymer material that forms the rest of base body 132. As shown, overmolded bottom bracket 164 may form or enclose the bottom end 136 of base body 132 (e.g., to at least partially enclose an interior cavity 138 defined by extended post 130).

Overmolded bottom bracket 164 may define a central aperture 168 that can be coaxially aligned, for example, with the output shaft 98 (e.g., at the internal shaft 98A) with the hole 158 of the mating collar 156. In some such embodiments, a connector bolt 170 is inserted through overmolded bottom bracket 164. Specifically, connector bolt 170 may extend through overmolded bottom bracket 164 (e.g., from interior cavity 138) to attach the extended post 130 to impeller base 120. For instance, connector bolt 170 extends along the rotation axis A to hold an overmolded bottom bracket 164 of extended post 130 against mating collar 156 at the top of impeller base 120. The connector bolt 170 may be a suitable mechanical fastener, such as a removable screw (e.g., having an enlarged head held within interior cavity 138) that is threaded or matched to the threaded axial hole 158 of the mating collar 156. When assembled, the connector bolt 170 may thus selectively maintain extended post 130 at a fixed vertical position relative to impeller base 120. Optionally, a resilient or deformable washer 172 may be disposed between overmolded bottom bracket 164 and mounting face 152. Optionally, washer 172 may radially span across and contact metal spline 158A. Advantageously, the connector bolt 170 may attach extended post 130 to impeller base 120 with significant clamp force (e.g., applied to overmolded bottom bracket 164) in a significantly resilient manner or without the risk of deformation or embedment that might accompany, for instance, a polymer bracket or elastomer washer.

Separate from or in addition to the overmolded bottom bracket 164, extended post 130 may include one or more vertical teeth 174. Specifically, base body 132 may include a plurality of vertical teeth 174 that extend from the bottom end 136. As shown, the vertical (e.g., C-shaped) teeth 174 are circumferentially spaced apart from each other about the rotation axis A (e.g., such that the opening of the C-shape is directed toward rotation axis A). The vertical teeth 174 may generally be matched to the receiver slots 160 to be received in the same. In turn, each vertical tooth 174 may be received in a discrete receiver slot 160 when extended post 130 is mounted to impeller base 120 to maintain extended post 130 at a fixed rotational position relative to impeller base 120 (e.g., to rotate therewith). Optionally, one or more interior ridges 162 may be received within the opening of the of the C-shaped profile of one or more vertical teeth 174.

Advantageously, engagement between the vertical teeth 174 and receiver slots 160 may selectively and rotationally fix extended post 130 to impeller base 120. Moreover, the connection between the mounting face 152 and mating face 154 may notably resist side loads (e.g., generated by articles within wash chamber 73) and maintain the position of extended post 130 relative to impeller base 120.

Figure 9:
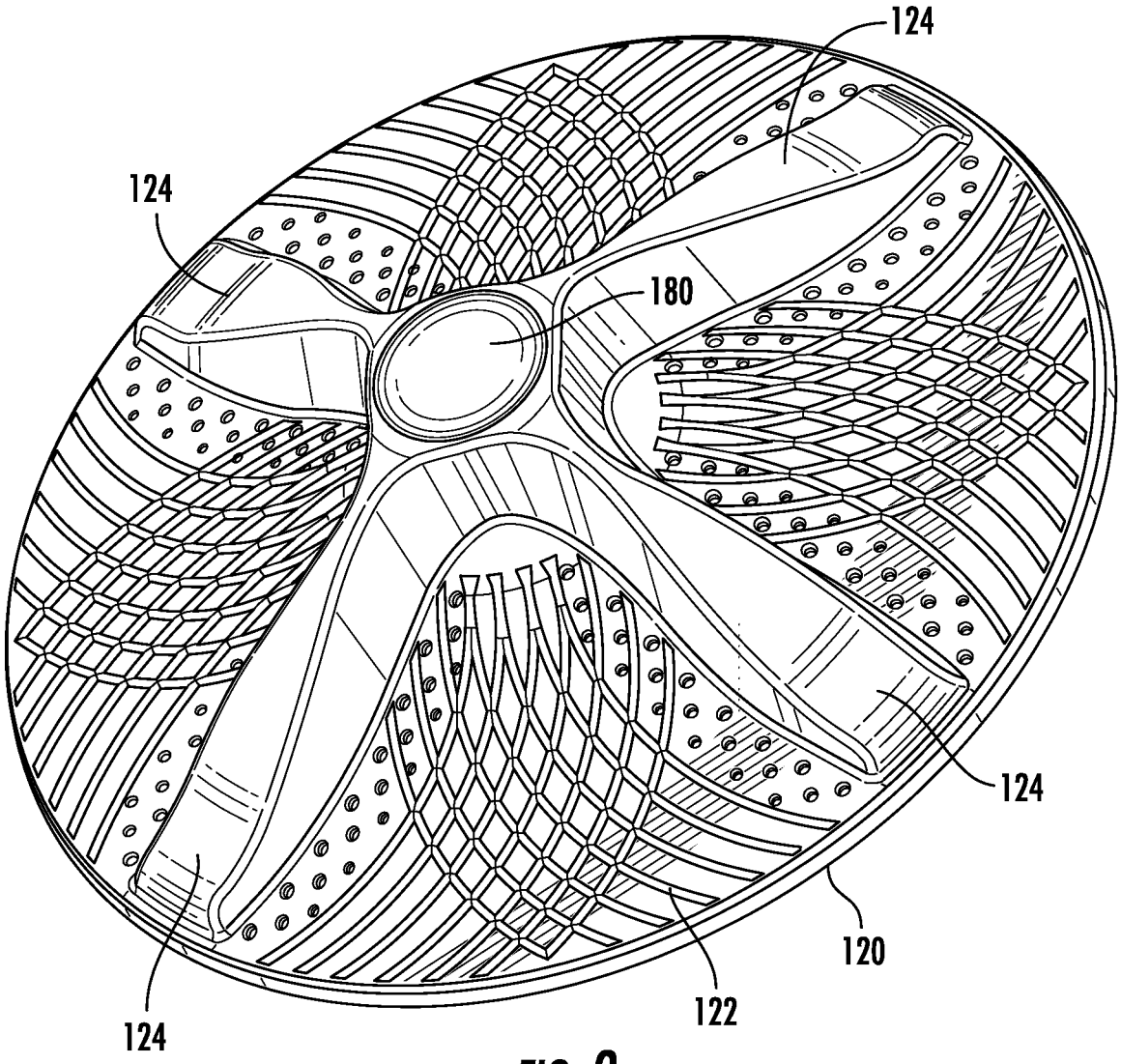
FIG. 9 provides a top perspective view of an exemplary impeller base.
Figure 10:
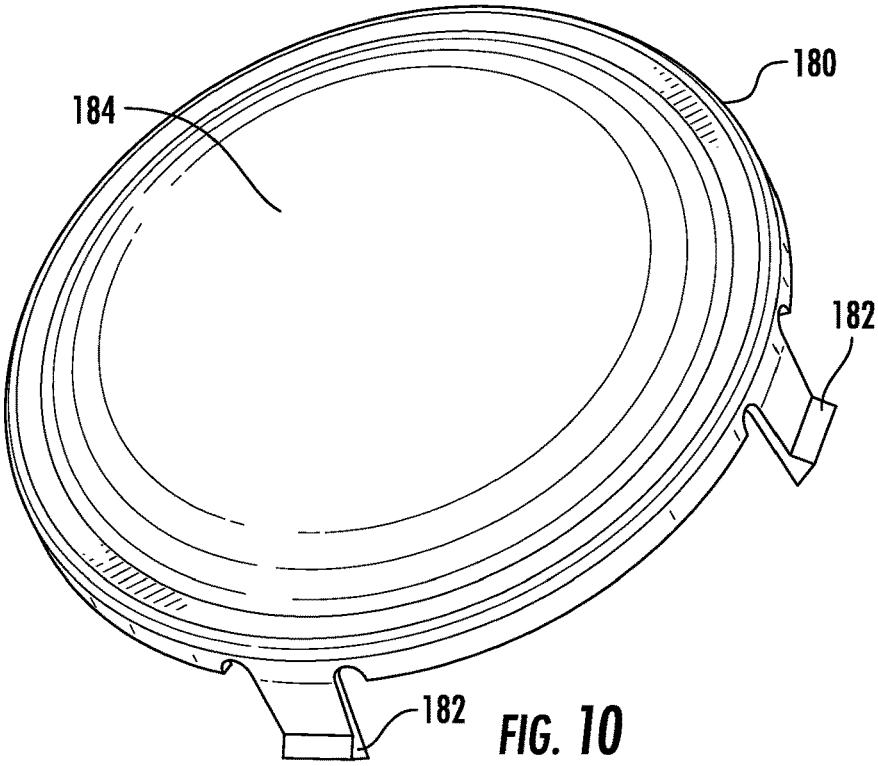
FIG. 10 provides a perspective view of a cap of the exemplary impeller base of FIG. 9.
Figure 11:
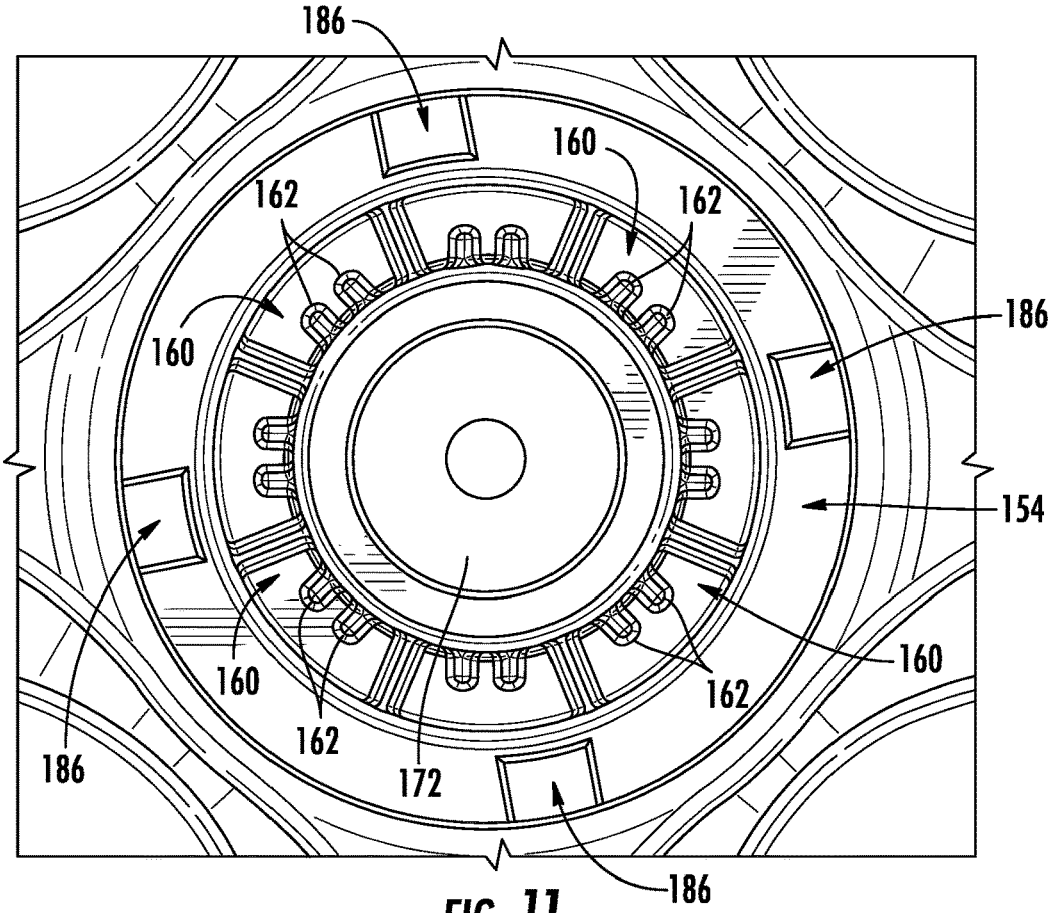
FIG. 11 provides a top perspective view of a portion of the exemplary impeller base of FIG. 9.
Figure 12:
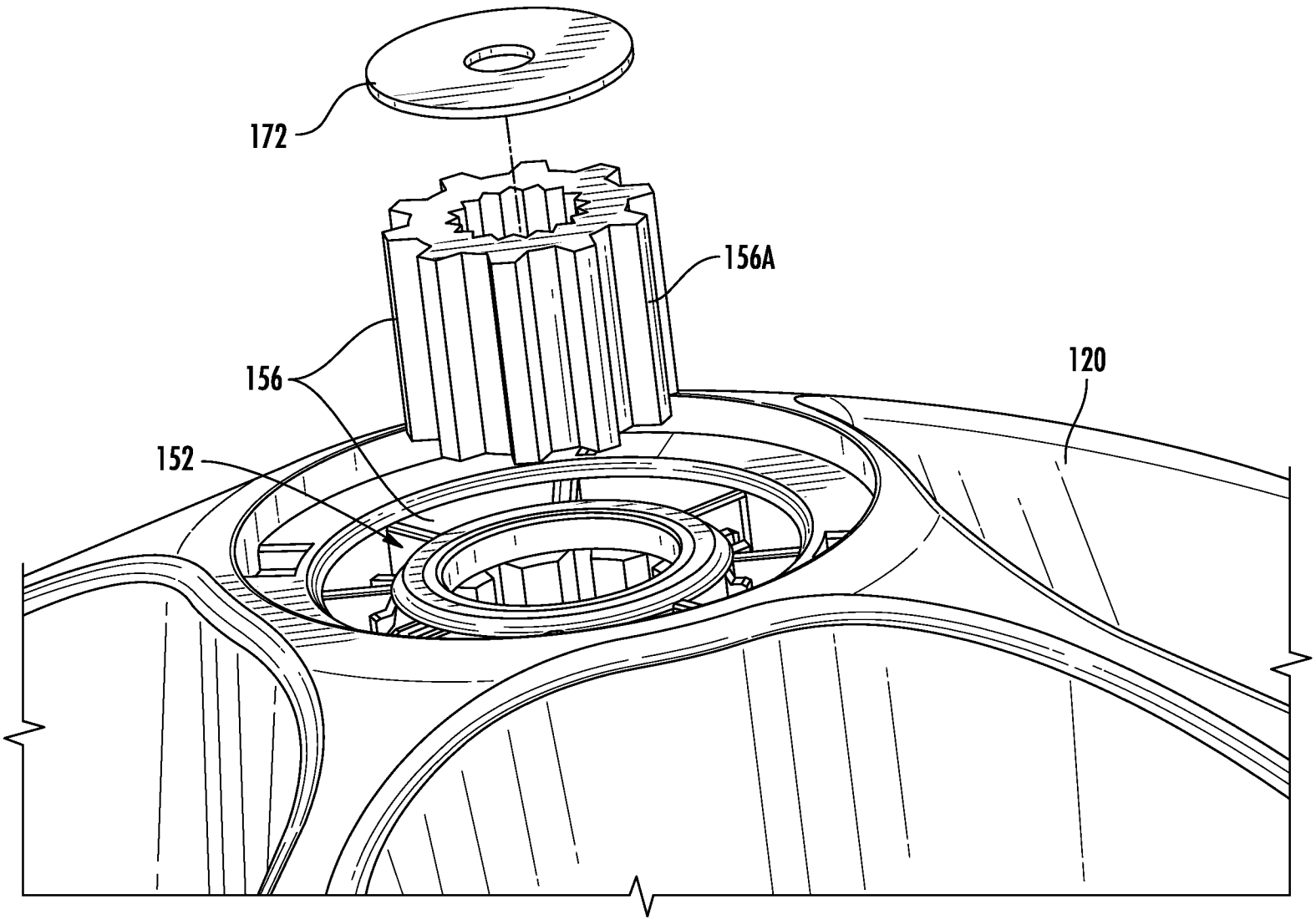
FIG. 12 provides a magnified exploded perspective view of a portion of an impeller base according to exemplary embodiments of the present disclosure.

Turning especially to FIGS. 9 through 11, certain embodiments further include an impeller cap 180 that can be mounted on or included with impeller base 120 to cover axial hole 158 or mounting face 152. By covering, axial hole 158 or mounting face 152, impeller cap 180 may generally hide axial hole 158 or mounting face 152 from a user's view or block it from contacting/receiving articles within wash chamber 73 when extended post 130 is removed from wash chamber 73. In some embodiments, impeller cap 180 is movably mounted on mounting face 152. Specifically, impeller cap 180 may be removably mounted to move apart from axial hole 158. For instance, impeller cap 180 may include one or more resilient attachment tabs 182 extending downward from a solid cap body or disk 184. In some such embodiments, the resilient attachment tabs 182 may be circumferentially spaced apart from each other. As shown, the attachment tabs 182 may be defined radially outward from the receiver slots 160. When assembled, the resilient attachment tabs 182 may be received within one or more connection notches or holes 186 that correspond to and complement the attachment tabs 182, as would be understood.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:

a tub;

a basket rotatably positioned within the tub;

an impeller base rotatably mounted within the basket and defining a rotation axis, the impeller base comprising one or more impeller fins extending radially outward from the rotation axis, and a mating collar disposed radially inward from the impeller fins and extending along the rotation axis;

an extended post removably attached to the impeller base to rotate therewith, the extended post comprising a base body extending along the rotation axis between a bottom end proximal to the impeller base and a top end distal to the impeller base, an auger fin extending radially from the base body between the bottom end and the top end, an overmolded bottom bracket disposed on the base body at the bottom end, the overmolded bottom bracket comprising a metal bracket frame that is overmolded within a non-metallic polymer material forming at least a portion of the base body, and a connector bolt extending through the overmolded bottom bracket to the mating collar; and an output shaft extending through the mating collar along the rotation axis, the output shaft receiving the connector bolt to attach the extended post to the impeller base, wherein the impeller base defines a plurality of vertical receiver slots circumferentially spaced apart about the rotation axis, wherein the base body comprises a plurality of vertical teeth selectively received within the vertical receiver slots, wherein the vertical teeth are formed according to a C-shaped profile, wherein the impeller base comprises a plurality of interior ridges extending radially outward from the mating collar, and wherein one or more interior ridges are received within an opening of the of the C-shaped profile of one or more vertical teeth of the plurality of vertical teeth.

2. The washing machine appliance of claim 1, wherein a threaded axial hole is defined radially inward from the mating collar and extends along the rotation axis.

3. The washing machine appliance of claim 1, wherein the connector bolt comprises a removable screw threadably engaged through the mating collar.

4. The washing machine appliance of claim 1, wherein the metal bracket frame defines a central aperture through which the connector bolt is received.

5. The washing machine appliance of claim 1, wherein the vertical teeth are disposed radially outward from the overmolded bottom bracket.

6. The washing machine appliance of claim 1, further comprising an impeller cap selectively disposable over at least a portion of the mating collar.

7. The washing machine appliance of claim 1, wherein the mating collar comprises a metal spline enmeshed with a portion of the output shaft, and wherein the impeller base further comprises a deformable washer disposed between the overmolded bottom bracket and the mating collar in contact with the metal spline.

8. An agitation element for a washing machine appliance, the agitation element comprising:

an impeller base defining a rotation axis, the impeller base comprising one or more impeller fins extending radially outward from the rotation axis, and a mating collar disposed radially inward from the impeller fins and extending along the rotation axis;

an extended post removably attached to the impeller base to rotate therewith, the extended post comprising a base body extending along the rotation axis between a bottom end proximal to the impeller base and a top end distal to the impeller base, an auger fin extending radially from the base body between the bottom end and the top end, an overmolded bottom bracket disposed on the base body at the bottom end, the overmolded bottom bracket comprising a metal bracket frame that is overmolded within a non-metallic polymer material forming at least a portion of the base body, and a connector bolt extending through the overmolded bottom bracket to the mating collar; and an output shaft extending through the mating collar along the rotation axis, the output shaft receiving the connector bolt to attach the extended post to the impeller base, wherein the impeller base defines a plurality of vertical receiver slots circumferentially spaced apart about the rotation axis, wherein the base body comprises a plurality of vertical teeth selectively received within the vertical receiver slots, wherein the vertical teeth are formed according to a C-shaped profile, wherein the impeller base comprises a plurality of interior ridges extending radially outward from the mating collar, and wherein one or more interior ridges are received within an opening of the of the C-shaped profile of one or more vertical teeth of the plurality of vertical teeth.

9. The agitation element of claim 8, wherein a threaded axial hole is defined radially inward from the mating collar and extends along the rotation axis.

10. The agitation element of claim 8, wherein the connector bolt comprises a removable screw threadably engaged through the mating collar.

11. The agitation element of claim 8, wherein the metal bracket frame defines a central aperture through which the connector bolt is received.

12. The agitation element of claim 8, wherein the vertical teeth are disposed radially outward from the overmolded bottom bracket.

13. The agitation element of claim 8, further comprising an impeller cap selectively disposable over at least a portion of the mating collar.

14. The agitation element of claim 8, wherein the mating collar comprises a metal spline enmeshed with a portion of the output shaft, and wherein the impeller base further comprises a deformable washer disposed between the overmolded bottom bracket and the mating collar in contact with the metal spline.

15. A washing machine appliance comprising:

a tub;

a basket rotatably positioned within the tub;

an impeller base rotatably mounted within the basket and defining a rotation axis, the impeller base comprising a mating collar extending along the rotation axis;

an extended post removably attached to the impeller base to rotate therewith, the extended post comprising a base body extending along the rotation axis between a bottom end proximal to the impeller base and a top end distal to the impeller base, a bottom bracket disposed on the base body at the bottom end, and a connector bolt extending through the bottom bracket to the mating collar; and an output shaft extending through the mating collar along the rotation axis, the output shaft receiving the connector bolt to attach the extended post to the impeller base, wherein the base body comprises a plurality of vertical teeth selectively received within the impeller base and formed according to a C-shaped profile, wherein the impeller base comprises a plurality of interior ridges extending radially outward from the mating collar, and wherein one or more interior ridges are received within an opening of the of the C-shaped profile of one or more vertical teeth of the plurality of vertical teeth.

16. The washing machine appliance of claim 15, wherein the connector bolt comprises a removable screw threadably engaged through the mating collar.

17. The washing machine appliance of claim 15, wherein the bottom bracket comprises a metal bracket frame defining a central aperture through which the connector bolt is received, and wherein the base body comprises a non-metallic polymer within which the metal bracket is overmolded.

18. The washing machine appliance of claim 15, wherein the vertical teeth are disposed radially outward from the overmolded bottom bracket.

19. The washing machine appliance of claim 15, further comprising an impeller cap selectively disposable over at least a portion of the mating collar.

20. The washing machine appliance of claim 15, wherein the mating collar comprises a metal spline enmeshed with a portion of the output shaft, and wherein the impeller base further comprises a deformable washer disposed between the bottom bracket and the mating collar in contact with the metal spline.

* * * * *